US005447012A

United States Patent [19]

Kovacs et al.

[11] Patent Number: 5,447,012

[45] Date of Patent: Sep. 5, 1995

[54] METHOD AND APPARATUS FOR PACKAGING GROUPS OF ITEMS IN AN ENVELOPING FILM

[75] Inventors: Lloyd Kovacs; Richard Sorenson, both of Sheboygan; Dale Cherney, Howards Grove, all of Wis.

[73] Assignee: Hayssen Manufacturing Company, Sheboygan, Wis.

[21] Appl. No.: 178,915

[22] Filed: Jan. 7, 1994

[51] Int. Cl.[6] ..... B65B 9/06; B65B 31/00; B65B 63/00

[52] U.S. Cl. ..... 53/433; 53/436; 53/438; 53/450; 53/511; 53/526; 53/530; 53/550; 53/370.6

[58] Field of Search ..... 53/511, 550, 450, 433, 53/438, 529, 526, 530, 370.2, 370.7, 371.8, 370.6, 372.6, 436

[56] References Cited

U.S. PATENT DOCUMENTS

| | | | |
|---|---|---|---|
| 3,017,730 | 1/1962 | Rodish | 53/529 |
| 3,848,398 | 11/1974 | Suhr | 53/530 |
| 4,430,844 | 2/1984 | James | 53/450 |
| 4,546,595 | 10/1985 | Yasumune et al. | 53/450 |
| 4,679,379 | 7/1987 | Cassoli | 53/438 |
| 4,930,292 | 6/1990 | Focke et al. | 53/550 X |
| 4,947,605 | 8/1990 | Ramsey | 53/550 X |
| 4,964,259 | 10/1990 | Ylvisaker et al. | 53/511 X |
| 5,150,561 | 9/1992 | Muckenfuhs | 53/438 X |
| 5,226,269 | 7/1993 | Stoltenberg | 53/550 X |

*Primary Examiner*—Linda Johnson
*Attorney, Agent, or Firm*—Lee, Mann, Smith, McWilliams, Sweeney & Ohlson

[57] ABSTRACT

An apparatus for enveloping successive groups of items in a plastic film as the items traverse a linear path. Items are gathered in a group, and the group of items is then inserted in a tubular packaging film as the items and the film are conveyed at the same linear velocity. After the items are completely enveloped in the film, the film is severed and sealed to fully encapsulate them in the film. A vacuum is used to eliminate excess air generated within the tube, and also, in one form of the invention, form side gussets as sealing dies are closed. A tight package made at speeds results, with no need for any holes in the film to relieve internal air pressure.

36 Claims, 7 Drawing Sheets

METHOD AND APPARATUS FOR PACKAGING GROUPS OF ITEMS IN AN ENVELOPING FILM

BACKGROUND OF THE INVENTION

This invention relates to packaging of items in a film, and in particular to an improved method and apparatus for packaging groups of compressible items tightly within a film as the items are transferred from an upstream location to a downstream location.

For many years, packaging machines have been made to accumulate a number of individual items into a group for overwrapping into a bundle, most commonly within a plastic film which partially or totally envelopes the group of items. The individual compressible items may be prewrapped in film or paper, or unwrapped, such as rolls of bathroom tissue, household towels, paper napkins, or other paper products which might be part of an already formed package, or might be singly presented to be gathered in a group. Once assembled in a desired grouping, the items are then overwrapped. One such automatic bundling machine is disclosed in U.S. Pat. No. 4,679,379 to Cassoli. In this apparatus, an assembled group of items is pushed into a partially-formed package which has already been sealed and severed at one end due to a previous sealing and severing operation. As the items are pushed into the package, they contact the previous seal, and are then pushed further to impart motion to the film and the group to advance them simultaneously to a sealing and severing station. As the film is advancing a rolling sealer seals the overlap of the tube and when fully advanced the tube is sealed and severed by a sealing and severing die which seals the rear of the package just completed and the front of the next package.

As a function of the sealing and severing operation the seals must be permitted a period of time to cool under pressure to enable the seal to achieve sufficient strength before being released from the sealing and severing dies. Failure to allow such cooling to "set up" the seal may cause premature seal failure.

The Cassoli apparatus, although a viable commercial machine and process, has serious limitations which directly affect the production rate and package quality:

1. Speeds of the machine in its commercial form are typically quoted at production rates of twelve packages per minute, but rarely is this rate achieved. Since, in order to advance the film, the group of items to be packaged is pushed into the tube to the seal at its end thus unwinding the film roll and continues until the correct amount of tubing has been formed. This method produces a severe strain on the newly created end seal which requires excessive cooling and thus severely limits the production capacity of the machine.

2. Since the film is being advanced by the group of items to be packaged pushing against the end seal, it is necessary to limit the velocity of the loading apparatus to reduce the pressure on the end seal, 3. If compression of the package product is desired, the amount of compression is severely limited by the strength of the end seal as the compression method used by Cassoli is that of fixed plates which cause added friction between the compression plate and the film adding to the pressure on the end seal. Compression therefore is minimal in the width direction of the package and there is nothing in the Cassoli apparatus for compressing the package in its length direction. For these reasons, the package produced by this apparatus has a relatively loose wrap.

4. A further problem involves expelling the air that may be trapped in front of the group of items as they are being forced into the partially made package. This air may escape between the items and the film if the film is loose or breathing holes may be punched in the film, usually in the area of the gussets to allow the release of this air. These bundles are often placed in open storage and punching holes in the film renders the package non water proof.

5. In order to produce a tightly wrapped compressed package with uniform end gussets, all causes of pressurized air must be substantially eliminated, otherwise the bundle will be difficult to handle through automatic warehousing systems and present an unpleasing appearance if the bundle is in fact sold as a unit.

It is therefore important to produce a packaging apparatus which when operating at substantial rates can bundle, compress and seal items in various geometric configurations in a package which is uniform, substantially waterproof, uniform in its dimensions and aesthetically pleasing at point of sale. The present invention meets all such criteria and solves the considerable problems of the prior art, as discussed above.

SUMMARY OF THE INVENTION

The invention relates to an apparatus for enveloping successive groups of items as the items are transferred from an upstream location to a downstream location in an intermittent manner. The apparatus includes means for accumulating a selected quantity of items into a group. A source of packaging film is available, and means is provided in the apparatus for continuously forming the package film into a tube with the groups of items in an equally spaced apart relationship, one with the other. If preprinted, registered film is to be used means is provided to register each group of items accurately with each printed label on the film. First means is provided for forming the flat web of film into a tube and sealing the longitudinal overlap and further means is provided for inserting each group of items into the tube, and further means is provided for simultaneously advancing this tube and the group of items in unison and synchronism with the inserting means. Means is also provided for clamping, evacuating excessive internal air pressure, gusseting, severing and sealing the tube adjacent to an inserted group of items.

In accordance with the preferred embodiment of the invention, the means for collating and accumulating the items in a group comprises a stationary collating surface. Means is provided for laterally compressing a group of items in that location. The compressing means comprise opposite side plates located on opposite sides of a group of items and means for shifting the side plates towards one another to compress the group of items therebetween to a desired extent. In accordance with the disclosed from of the invention, two pairs of the side plates are located in series so that one pair of side plates can be released while the second pair of side plates continues to compress items as they are conveyed from the stationary collating surface.

A reciprocating means with an articulated pusher plate is positioned to engage the upstream end of a group of items. The articulated pusher plate descends and the reciprocating means moves the pusher plate forward to engage the group of items and the film tube at exactly the same velocity and continues until the last item of the group is in contact with the film. The articulated pusher plate raises and is returned by the reciprocating means to avoid interference with a succeeding group of items.

The advancing means for the tube and group of items comprise pull belts positioned on each side of the tube and groups of items and a motor for propelling the pull belts. A motor is provided for driving the reciprocating means with the articulated plate, and a controller is provided to each of the aforesaid motors to operate the motors such that the reciprocating means and the side belts advance the tube and the group of items at the same linear velocity.

In addition to the side pull belts, top and bottom pull belts can be provided, and be driven by a motor controlled by the controller such that the top and the bottom belts are driven at the same linear velocity as the side pull belts.

The side pull belts and/or the top and bottom pull belts terminate at a pair of sealing and severing dies which periodically seal and sever the tube between successive groups of items to form sealed packages.

A second pair of side pull belts operating at the same linear velocity as the first side pull belts, spaced from and located downstream from the sealing and severing dies, creating a gap between the two sets of pull belts to accommodate the intervening sealing and severing dies, is utilized to advance the packages beyond the sealing and severing dies prior to sealing and severing. Therefore in one form of the invention during the time that the sealing and severing dies are in the open position, means is provided for temporarily moving the upstream side pull belts towards the downstream side pull belts to decrease and substantially eliminate the gap between these pull belts. Prior to the sealing dies closing the upstream side pull belts revert to their original position.

The downstream second pair of side pull belts engage opposite sides of the package which is already sealed at its downstream end. In this condition, with the package upstream of the sealing and severing dies held by the side belts, and the package downstream of the sealing and severing dies held by the side belts, the sealing and severing dies on closing would cause extreme tension to be exerted on the film. To eliminate this, means is provided for separating the second downstream side pull belts to temporarily release the group of items. As the sealing and severing dies are closed the upstream package moves towards the sealing dies to assure a package of uniform and controlled tightness. Reversing the side pull belts in their compressing position and in a controlled manner may also be used.

As the sealing and severing dies close between the upstream group of items and the downstream group of items, the volume of the tube between these items is decreased to zero. In order for the sealing and severing dies to close at a high velocity it is necessary to rapidly remove the air as the volume of the tube decreases. In accordance with the preferred form of the invention, vacuum means is provided for withdrawing this air.

The vacuum means comprises an elongated tubular lance having an air inlet proximate the sealing dies. The lance extends from a position upstream of the forming means where the film is formed into a tube, through the formed tube and to the sealing dies.

Gussets are formed in the tube as the sealing dies are closed. In one form of the invention, opposite gusset plates are located each side of the film tube adjacent to the sealing and severing dies, and means is provided for moving the gusset plates towards one another to tuck opposite sides of the tube as the sealing and severing dies close.

In another from of the invention, gussets are formed without mechanical assistance. In this form of the invention, a vacuum is applied to the gap between two succeeding groups of items in the area of the sealing and severing dies. In this form of the invention the vacuum removes the air expelled by the collapsing of the tube by the sealing and severing dies and at the same time the film collapses informally due to the atmospheric pressure on the outside of the film to produce a uniform gusset which follows exactly the cross section of the group of items.

The process according to the invention results in successive groups items being packaged as they progress from an upstream location to a downstream location. First, a desired quantity of items is collated and accumulated into a group. Immediately downstream of the group the packaging film is formed into a tube. The group of items is then inserted into the tube while the tube and group of items is advanced at the same velocity. Thereafter the tube is gusseted, severed and sealed at a location between successive groups of items.

Preferably in the process according to the inventions the group of items, after having been collated and accumulated is laterally compressed before insertion into the tube. During insertion the items are generally at the same velocity as the film tube which is simultaneously engaged on opposite sides with side pull belts. The pull belts advance the tube and group of items at the same velocity as the items enter the tube under controlled compression. It is also preferred that the tube and enveloped items engage with top and bottom pull belts which are driven at the same velocity as the side pull belts.

The method also includes conveying the group of items downstream of the sealing and severing dies. The downstream conveying means is separated from the upstream side of the pull belts to accommodate the sealing and severing dies. Thus, the process according to the invention can also include the step of temporarily moving the upstream side pull belts towards the downstream side pull belts in order to reduce or eliminate the gap between the upstream and downstream side pull belts.

A further step of the process according to the invention involves separating the downstream side pull belts after a group of items is past the sealing and severing dies in order to permit a group of items to move towards the sealing and severing dies as they are closed.

In the preferred form of the process according to the invention excess air pressure within the tube caused by the collapsing of the film tube the closing of the sealing and the severing dies is withdrawn by vacuum means. Shaping of the side gussets occurs as the sealing dies are closed, and in one form of the process according to the invention, the shaping of the side gussets may be obtained by atmospheric pressure on the outside of the film caused by a vacuum means between the two groups of packages while the sealing and severing dies are descending.

BRIEF DESCRIPTION OF THE DRAWINGS

The invention is described in greater detail in the following description of examples embodying the best mode of the invention, taken in conjunction with the drawing figures, in which.

DESCRIPTION OF THE EXAMPLES EMBODYING THE BEST MODE OF THE INVENTION

Figure 1:
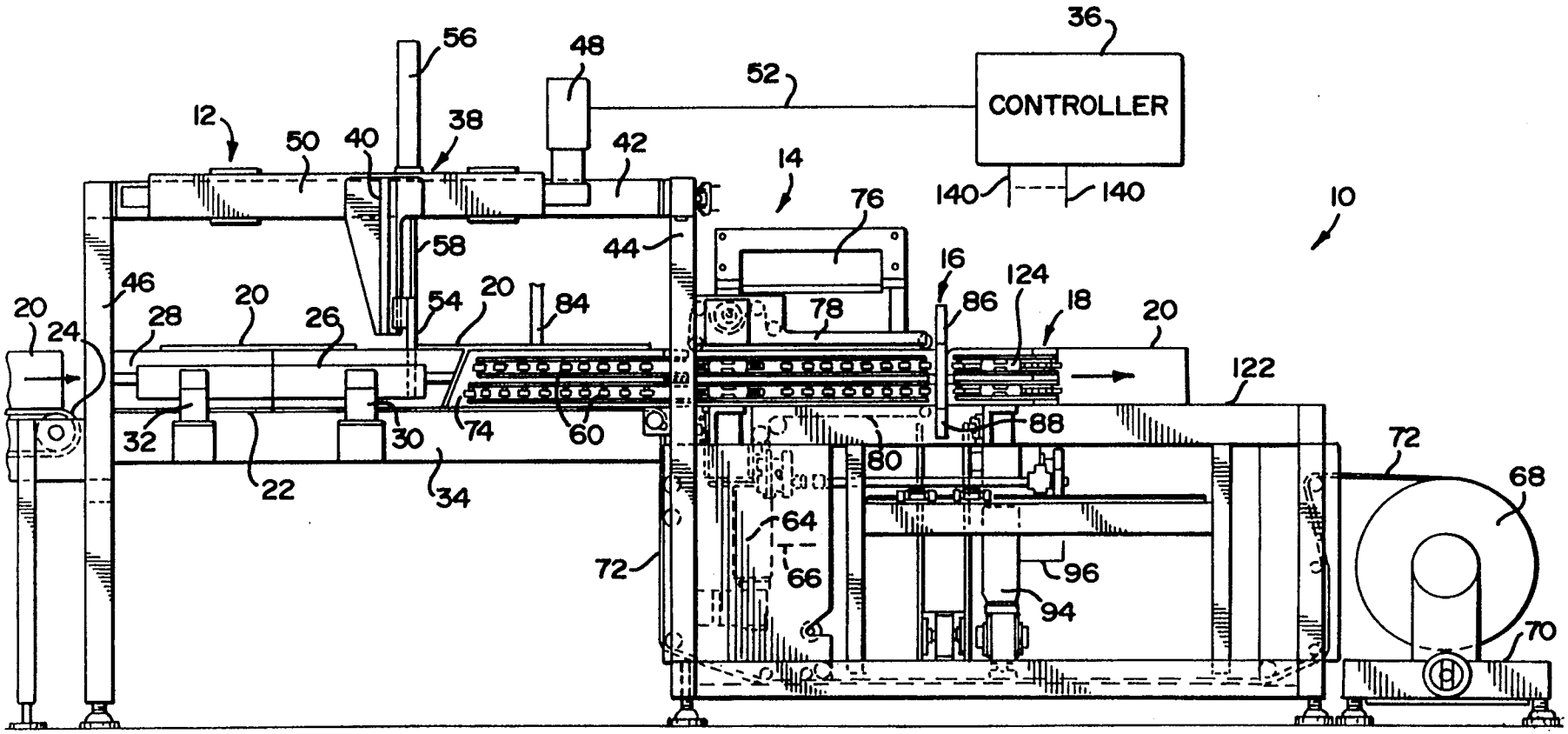
FIG. 1 is a side elevational view, somewhat schematically, of an apparatus according to the invention for enveloping successive groups of items in a film.

An apparatus according to the invention for enveloping successive groups of items in a packaging film is designated generally at 10 in the drawing figures. The apparatus 10 although a continuous structure, is composed of basic sections, an input section 12, a conveying and lap sealing section 14, an end sealing section 16 and an outlet section 18. As will be seen from the description below, the apparatus 10, when operated, passes items in groups from the input section 12 to the outlet section 18. The apparatus 10 is operated in a continuous manner to intermittently pass the group of items 20 therethrough.

The input section 12 is where a group of items 20 is collected and located for further conveying intermittently in collected groups within the apparatus 10. Throughout the drawing figures, a group of items, which may comprise rolled tissue, whether prepackaged or not, packages of napkins, boxes of food products or other items, is designated at 20, whether upstream of or enveloped within the packaging film, as described in greater detail below.

Figure 2:
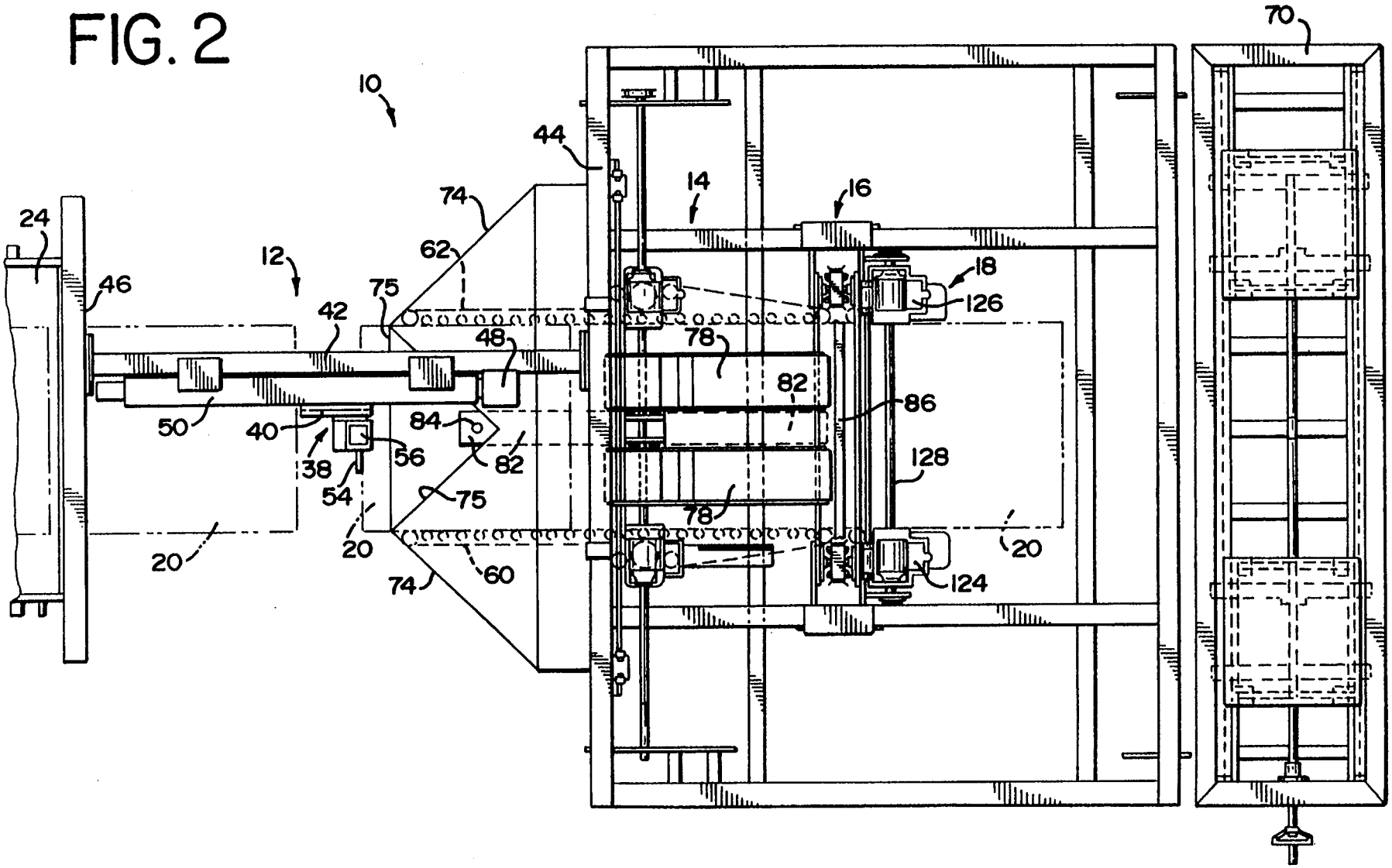
FIG. 2 is a top plan view of the apparatus according to FIG. 1, with several elements removed in order to illustrate detail.

The input section 12 includes a collator 22, often known as a dead plate, upon which a group of items 20 is collated and accumulated in a group 20 after having been transported thereto, as by means of an upstream conveyor 24. Two pairs of side plates 26 and 28 are positioned immediately above the collator 22 on opposite sides of a group 20 entering the input section 12o One side plate of each pair 26 and 28 is illustrated in FIG. 1 (and none are illustrated in FIG. 2), it being evident that the opposite side plate of each pair is identical to that illustrated in FIG. 1.

Each of the side plates of the pairs 26 and 28 is moveable toward and away from one another by means of respective actuators 30 and 32 connected to the respective side plates 26 and 28 and mounted on a frame 34 of the input section 12. The actuators 30 and 32 are appropriately connected to a controller 36, which is described in somewhat greater detail below. The controller 36, as explained, controls the various operating functions of the apparatus 10, and controls the actuation of the actuators 30 and 32 to control the amount of compression, if any, of the group of items 20 contained between the respective pairs of side plates 26 and 28. Also, since the side plate pairs 26 and 28 are independently actuated, one of the pairs of side plates 26 and 28 can be advanced toward one another to compress a group of items 20, while the other pair is retracted. That is particularly advantageous during typical operation of the apparatus 10, where compression of a collected group is desired and an upstream group 20 or one or more members of that group is about to enter the input section 12. The pair of side plates 28 can be retracted to accept an incoming members of a group 20 while an exiting group is still compressed between the downstream pair of side plates 26.

The input section 12 also includes an overhead inserting apparatus 38. The inserting apparatus 38 includes a carriage 40 mounted on a horizontal beam 42 extending between opposite upright supports 44 and 46 between which the frame 34 is mounted. The carriage 40 is reciprocated by a motor 48 along a track 50 secured to the beam 42. The motor 48 is also secured to the beam 42, and is controlled by the controller 36. An electrical connection 52 between the motor 48 and the controller 36 is schematically illustrated in FIG. 1.

The carriage carries a pusher plate 54 which is used to deposit a group of items 20 from the collator 22 into the conveying and lap sealing section 14. The pusher plate 54 is mounted in the carriage 40 for vertical displacement, and is connected to a vertical actuator 56, such as by means of a reciprocating means 58 for vertical displacement of the pusher plate 54. The actuator 56 is also connected to and controlled by the controller 36.

In FIG. 1, the pusher plate 54 is shown in its downward displacement, bearing against a group of items 20 as that group of items exits the input section 12 into the conveying and lap sealing section 14. After the carriage 40 has traversed the track 50 to its limit (with the plate 54 generally at the right-most end of the side plates 26), the actuator 56 is activated to raise the plate 54, and the carriage 40 is returned to the left (in relation to FIGS. 1 and 2) to an initial position generally adjacent the left most ends of the side plates 28. After a further group of items 20 is inserted onto the collator 22, the pusher plate 54 is then lowered, and the insertion process from the collator 22 to the conveying and lap sealing section 14 can be repeated.

The conveying and lap sealing section 14 includes opposite side pull belts 60 and 62. The pull belts 60 and 62 may, as illustrated, each comprise a pair (or more) of pull belts, or each may comprise a single pull belt. Also, each of the pull belts 60 and 62 may be a single belt, or can compose belt sections throughout the length of the conveying and lap sealing section 14. The pull belts 60 and 62 are driven by an appropriate driving means 64 which is appropriately connected to the pull belts (means not shown in detail) for the driving thereof. The driving of the belts and the means of interconnection of the belts can be conventional and therefore is not shown or described in greater detail. In any event, the driving means 64 is activated by the controller 36 and is connected by a line 66 leading thereto.

The conveying and lap sealing section is also where each group of items 20 is first introduced to the packaging film in which the items are enveloped. To that end, a roll of packaging film 68 is appropriately positioned in a roll buggy 70, and film 72 is fed therefrom over rollers and through the apparatus 10 to a forming head 74. The means of mounting of the film, the various rollers over which the film passes, and mechanical driving of the film (if any) may all be conventional, and therefore are not shown or described in greater detail. Also, as is conventional, various take up rollers can be employed to apply appropriate tension to the film 72 and take up slack, and such are also not illustrated.

The forming head 74 forms the film 72 into a tube encapsulating the successive groups of items 20. The forming head 74 can be configured as appropriate to accommodate a group of items 20, as is well known in the art. The plastic film 72 passes over the exterior of the forming head 74 and is shaped into a tube in an entrance 75 as the film reverses direction and passes with a group of items 20 into the conveying and lap sealing section 14. The adjustable girth former as illustrated in U.S. Pat. No. 5,255,495 can be employed for this purpose. Alternatively, any conventional forming device can be used.

When the film 72 enters the forming head 74 and envelopes a group of items 20, the film edges are overlapped so that the overlapping edges can be sealed to form a tube enveloping the group of items 20. A lap sealer 76 is employed for this purpose. The lap sealer 76 may be conventional, and can be of any form. Preferably, however, the lap sealer 76 is a hot air lap sealer which is brought into sealing position proximate the film 72 each time the film and encapsulated group of items 20 is moved through the section 14.

It is preferred that the apparatus 10 be capable of compressing, when desired, groups of items as they are packaged, so that the resulting package is tight. To maintain package integrity and compress a group .20 vertically, top pull belts 78 and bottom pull belts 80 are also employed. The driving means 64 is appropriately connected to the pull belts 78 and 80 to drive the pull belts 78 and 80 at the same linear velocity as the pull belts 60 and 62. Preferably, the top pull belt 78 is split into a pair of pull belts, as shown in FIG. 2, so that the lap sealer 76 (which is not shown in FIG. 2) can be activated therebetween to lap seal the overlapping edges of the film 72.

For withdrawing entrapped air from within the film tube, a vacuum lance 82 is located within the conveying an lap sealing section 14 immediately adjacent the top of each of the succeeding group of items 20. The vacuum lance 82 extends from the entrance 75 through the length of the section 14 between the pull belts 78 and terminates at the end sealing section 16. Since the sealing section 16 includes vertically actuated sealing and severing dies (as explained in greater detail below) the lance cannot extend into the sealing section 16, but extends as close as practical to the sealing dies. The lance 82 is hollow, and is connected by a vacuum tube 84 to a source of vacuum (not illustrated) which is controlled by the controller 36.

Figure 3A:
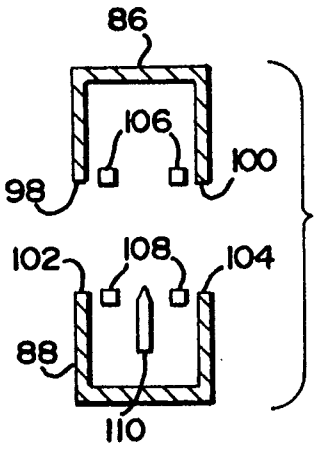
FIG. 3A is an enlarged cross-sectional schematic view showing a basic form of sealing die according to the invention.
Figure 3:
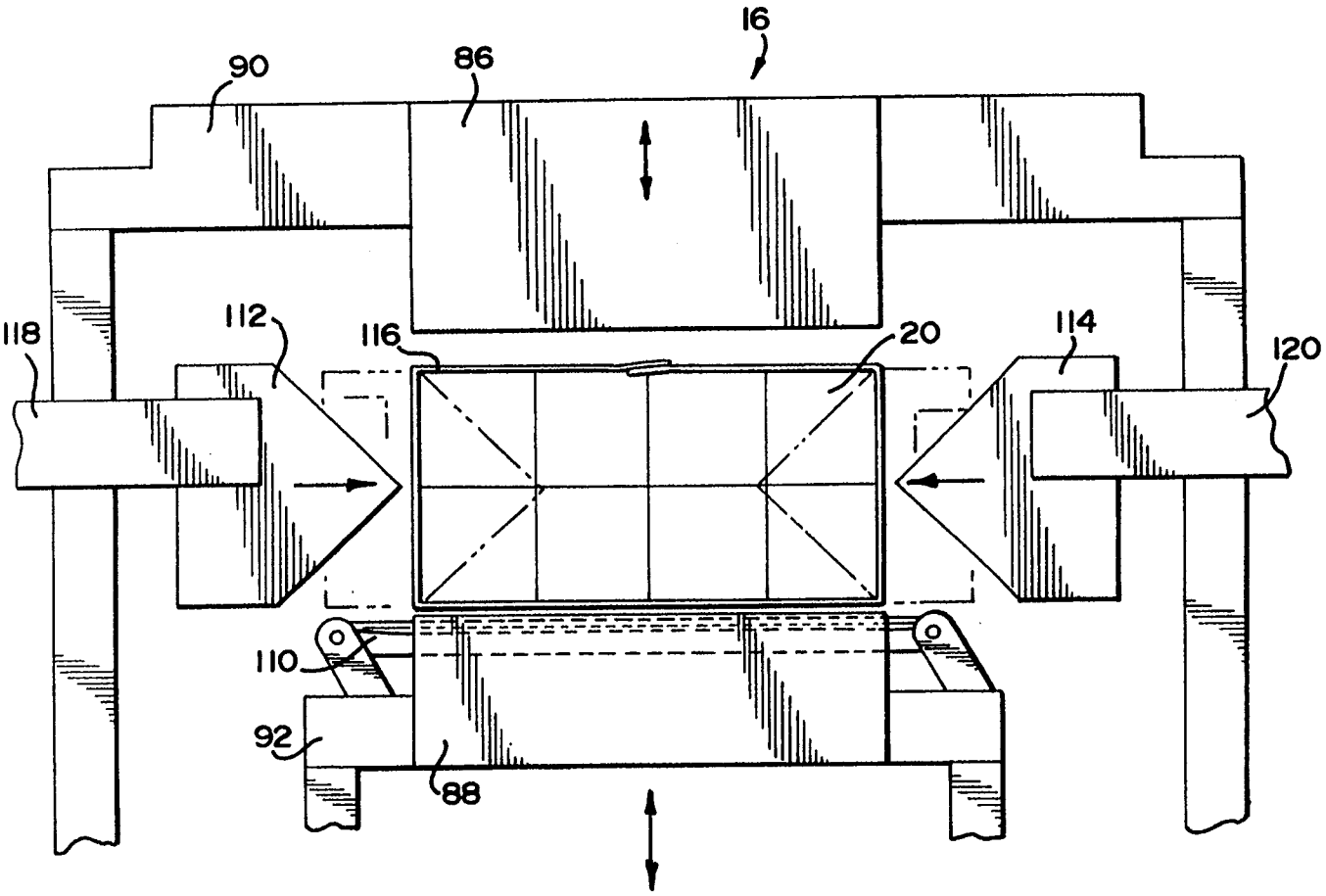
FIG. 3 is a schematic illustration of mechanical side gusseting and operation of sealing dies according to the invention.

The end sealing section 16 is shown in greatest detail in FIG. 3. The sealing section 16 includes a pair of sealing severing dies 86 and 88, each of which is mounted on a respective frame 90 and 92 for vertical displacement toward and away from one another. An appropriate driving means 94 (FIG. 1) is connected to the frames 90 and 92 in a conventional manner (not illustrated) for closing the dies 86 and 88 at the appropriate time. The driving means 94 is connected by a line 96 to the controller 36.

The top sealing die 86 includes clamp elements 98 and 100 which engage corresponding clamp elements 102 and 104 of the lower sealing die 88. Each of the sealing dies 86 and 88 also includes a pair of sealing ribbons 106 and 108 for sealing ends of the respective groups of items between which the sealing dies 86 and 88 are closed. Although only two sealing ribbons 106 and 108 are shown, additional sealing means can be used to produce packages with label headers, handles or other features. Finally, a severing knife 110, also carried by the frame 92, is located in the lower sealing die 88 between the sealing ribbons 108 and is connected to the controller 36 for activation when severing of the clamped film is desired. Alternatively, a hot wire can be employed in place of the knife 110, if desired.

For forming side gussets in the film 72, gusset plates 112 and 114 are located on opposite sides of the tube 116 enveloping the group of items 20. The gusset plates 112 and 114 each comprise a pair of gusset plates which are located on either side of the sealing dies 86 and 88 when the dies 86 and 88 are closed. Each of the gusset plates 112 and 114 is affixed to a respective carrier 118 and 120 which is linked to an appropriate driving means (not illustrated) connected to the controller 36 for appropriate reciprocation of the gusset plates 112 and 114.

The outlet section 18 performs two basic functions. First, it accepts a group of items 20 encapsulated within the tube 116 as that group of items is being passed from conveying and lap sealing section 14 to the outlet section 18. Also, once sealing and severing has been accomplished by the end sealing section 16, the outlet section 18 also conveys the now fully-sealed package on its way for appropriate downstream handling (not illustrated).

The outlet section 18 includes a horizontal dead plate 122 and opposite pull belt assemblies 124 and 126o The pull belt assemblies 124 and 126 each include at least a single pull belt, and as illustrated in FIG. 1, each may comprise a pair of pull belts driven at the same linear velocity as the side pull belts 60 and 62. The pull belts of the pull belt assemblies 124 and 126 may be identical to the pull belts 60 and 62, although normally shorter versions thereof are used, as illustrated. A drive shaft 128 interconnects the pull belt assemblies 124 and 126 so that the pull belts of the pull belt assemblies 124 and 126 are driven in precise synchronism. The drive shaft 128 is part of the means for driving the pull belt assemblies 124 and 126, and a conventional driving means or motor may be used (all not illustrated) may be employed, connected to and controlled by the controller 36.

The pull belt assemblies 124 and 126 are also mounted so that they can be separated laterally in order to release the group of items 20 contained therebetween. Release occurs when the dies 86 and 88 of the sealing section 16 are closing so that the tightest possible package can be effected by allowing the group of items 20 to actually reverse direction due to the pull generated by the closing sealing dies 86 and 88. Also, the pull belts of the pull belt assemblies 124 and 126 can be driven in reverse to accomplish the same results, if the pull belt assemblies 124 and 126 are not mounted for lateral separation.

Once a package has been completely formed of a group of items 20 sealed within a portion of the film 72, those items are then removed from the outlet section 18. While the pull belts of the pull belt assemblies 124 and 126 are activated to that end, since the pull belt assemblies 124 and 126 are relatively shorts other means of removing the package from the apparatus 10 can be employed, such as locating a conveyor belt in the area of the dead plate 122 to accept a fully-sealed package as it exits the two pull belt assemblies 124 and 126. Other means of handling of the sealed packages, as would be evident to one skilled in the art, can also be employed.

Figure 4:
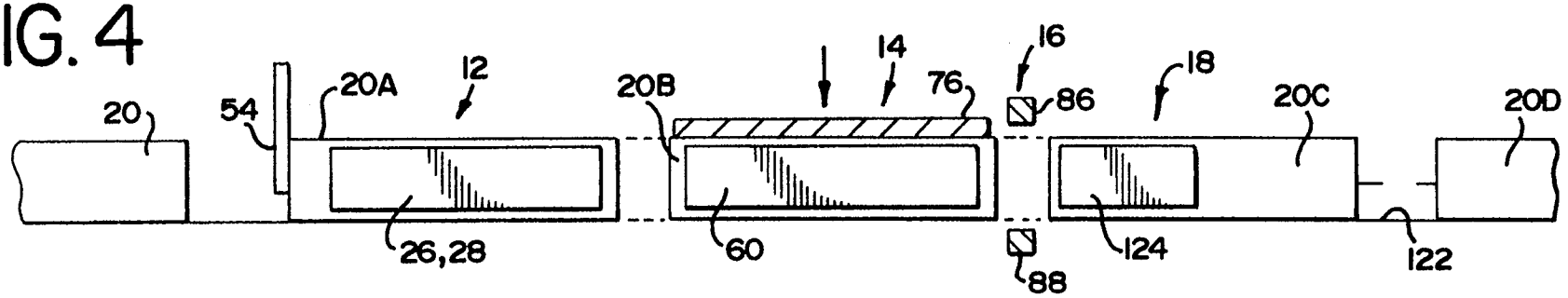
FIG. 4 illustrates one step of the sealing process according to the invention, where the film and product are moved into sealing position with a pusher plate in a lowered position and in synchronism with the film velocity.
Figure 5:
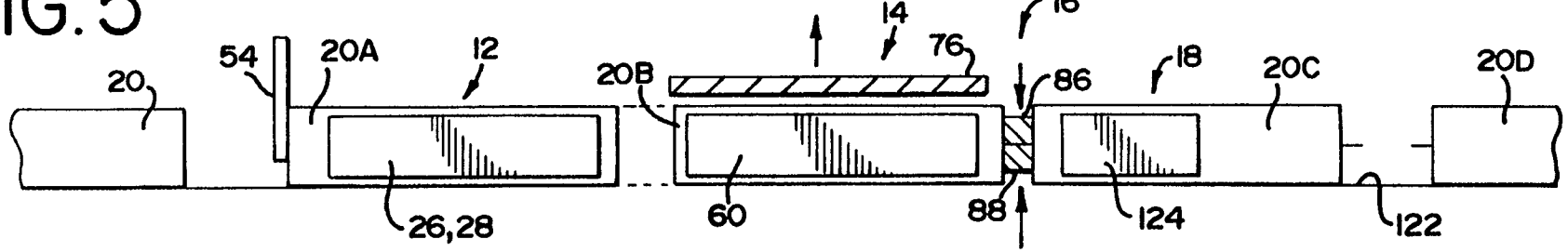
FIG. 5 illustrates a successive step of the sealing process according to the invention, where the group of items and film are in position at the sealing dies with the pusher plate still in contact and the dies slightly closed.
Figure 6:
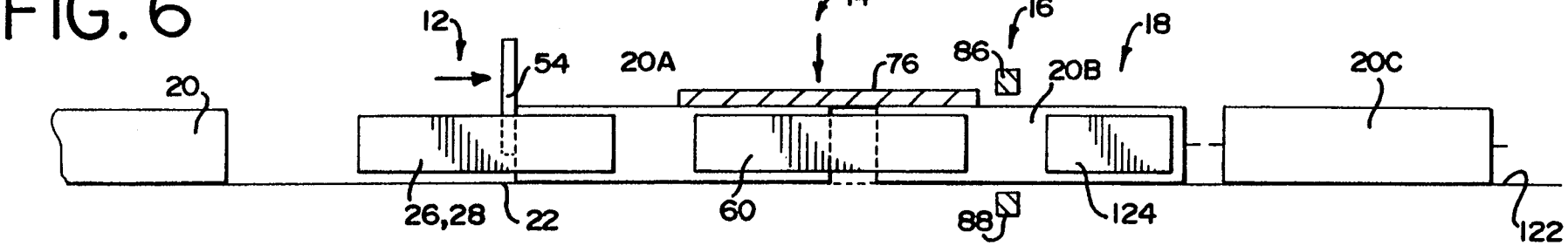
FIG. 6 illustrates a further successive step of the sealing process according to the invention, with the dies closed and the pusher plate raised and fully retracted, FIG. 7 schematically illustrates the expansion of a group of items as passing from upstream pull belts to pull belts downstream of the sealing dies.

FIGS. 4 through 6 schematically illustrate various steps in the sequence of sealing a group of items 20 in the film 72. Elements of the invention, although shown very schematically in FIGS. 4 through 6, carry the same reference numeral in order to ease explanation, although obviously details are not shown in FIGS. 4 through 6 and elements are shown substantially in block format. Also, normally the film 72 or its formation in the tube 116 is not illustrated, except for the end seals of a package downstream from the sealing section 16.

FIG. 4 illustrates a configuration and location of the various groups 20 passing through the apparatus 10 according to the invention close to what might be considered to be an "initial" position of the apparatus. In this drawing, a group of items 20A is positioned in the input section 12 with the pusher plate 54 situated therebehind, and prepared to push the group of items 20A into the conveying and lap sealing section 14. A second group of items 20B is being conveyed through the conveying and lap sealing section 14, and the lap sealer 76 has been displaced downwardly and activated to seal the film (not illustrated) along the top of the group of items 20B to complete the tube (not illustrated). At this instance, the dies 86 and 88 of the sealing section 16 are open as the third group 20C has just been conveyed therebetween from the conveying and lap sealing section 14 into the output section 18.

FIG. 5 illustrates a further step in the sequence of sealing, where the forward motion of the group 20B has been halted and the lap sealer 76 is moved out of sealing contact with the film about the group 20B. The group 20C remains in place, and the pull belt assemblies 124 and 126 of the sealing section 18 have released the group 20C for sealing purposes. At this point the sealing dies 86 and 88 have been closed on the film between the groups 20B and 20C. The groups 20B and 20C contact opposite sides of the dies 86 and 88. The film is clamped, severed and sealed by the dies 86 and 88 when at this position. Since the group 20C has been released by the pull belt assemblies 124 and 126, it is free to be drawn tightly toward to the sealing dies 86 and 88 as they close and the gussets are formed, and it can be seen that the group 26C as shown in FIG. 5 is actually displaced slightly to the left in relation to the group 26C shown in FIG. 4o In this drawing figure, the group 20A remains positioned behind the pusher plate 54, ready to be inserted in the conveying and lap sealing section 14 at the appropriate time.

In FIG. 6, sealing has been completed, and the package 26C is being conveyed from the outlet section 18. The sealing dies 86 and 88 have been opened, and the group 26B, which is partially sealed only at its right end, is being transferred from the pull belts of the conveying and lap sealing section 14 to the pull belts of the outlet section 18. At this time, the lap sealer 76 has been lowered and is lap sealing the tube as the film and encapsulated items are conveyed from left to right. Also, the pusher plate 54 has been activated, and the group 20A is being conveyed from the input section 12 into the conveying and lap sealing section 14. As explained above, the linear velocity of the pusher plate 54 matches the linear surface velocity of the pull belts of the conveying and lap sealing section 14 so that there is a smooth transition from the input section 12 to the conveying and lap sealing section 14 of both the group of items 20A and the encapsulating film surrounding the items in the conveying and lap sealing section 14. The pusher plate 54 continues to propel the group of items 20A to the right as shown in FIG. 6 until they reach the full extent of travel of the pusher plate 54 (approximately at the location of the group 20B in FIG. 4). At this points the pusher plate 54 is raised and returned to its initial position while the next group of items 20 is conveyed into the input section 12 to occupy the position of the now-displaced group 20A.

Given the above short description of the sequence of operation according to the invention, a more detailed description is now given. At what might be considered to be the start of a complete cycle, a group of items 20 is positioned in the input section 12 with the pusher plate 54 lowered and ready to propel those items into the conveying and lap sealing section 14. A second group of items sits in the conveying and lap sealing section 14, just after the sealing dies 86 and 88 have opened, sealing the film between that group of items and a third, downstream group of items in the outlet section 18. At this position in the cycle, the lap sealer 76 is lowered, and simultaneously the pusher plate 54, pull belts of the conveying and lap sealing section 14 and pull belts of the outlet section 18 are activated, conveying all three groups 20 at the same linear velocity.

When the groups 20 reach the positions shown generally at the positions of the groups 20B, 20C and 20D of FIG. 4, the pull belts of the outlet section 18 are deactivated, and the group 20 contained therebetween is released. At the same time, closing of the dies 86 and 88 is activated, while the group 20 contained in the conveying and lap sealing section 14 continues to be conveyed in order to shorten the gap between the two groups 20 spanning the sealing section 16 so as not to stretch the plastic film therebetween. Also, at this point the pusher plate 54 has completed its forward motion, and it is raised and returned to permit a further group of items 20 to be contacted and later conveyed.

As the dies 86 and 88 are closed, vacuum to the lance 82 is activated. If the mechanical gusset plates 112 and 114 are utilized to form the gussets, they are activated in unison with closing of the sealing dies 86 and 88. Once the sealing dies 86 and 88 have been fully closed, the gusset plates 112 and 114 are retracted.

Also, once the dies 86 and 88 are fully closed, the pull belts 60 and 62 are deactivated. The lap sealer 76 is raised while the film 72 is in a stationary position after having completed its lap sealing. Also, vacuum to the vacuum lance 82 is deactivated since the dies 86 and 88 are fully closed. At this timed the knife 110 is activated to sever the film between the two clamped groups 20. Also, the sealing ribbons 106 and 108 are activated to seal opposite ends of the two groups 20.

Once a predetermined sealing time has elapsed, preferably the pull belts 60 and 62 are advanced slightly to release any tension remaining in the clamped group 20 in the conveying and lap sealing section 14. Then, the sealing dies 86 and 88 are opened slightly, and cooling air is injected between the dies to cool the still-molten seals in the plastic film. Also, if the gusset plates 112 and 114 have not been previously retracted, they are retracted at this time.

After the seals are sufficiently cooled, the dies 86 and 88 open fully, and if a new group 20 is positioned in the input section 12, the pusher plate 54, pull belts of the conveying and lap sealing section 14, pull belts of the outlet section 18, and lap sealer 76 are again activated in the sequence described above to continue the packaging process to seal the next group of items 20. This sequence of operation continues for succeeding groups of items 20 to intermittently seal the groups as described.

Figure 7:
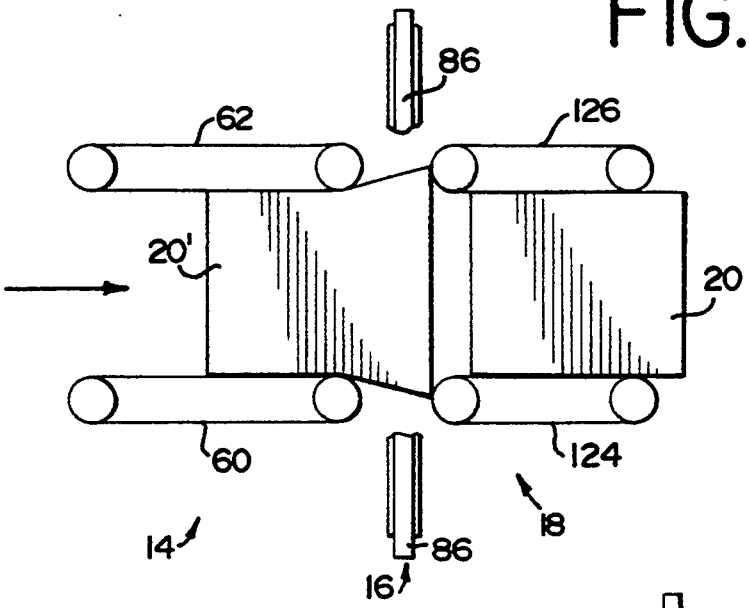
Figure 8:
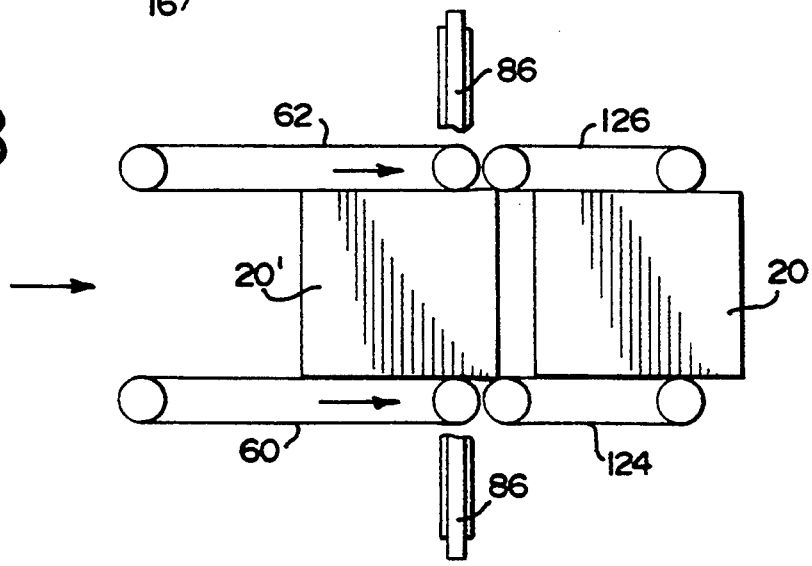
FIG. 8 illustrates a further form of the invention where the upstream side pull belts are temporarily shifted to eliminate a gap between the upstream and downstream side pull belts.
Figure 9:
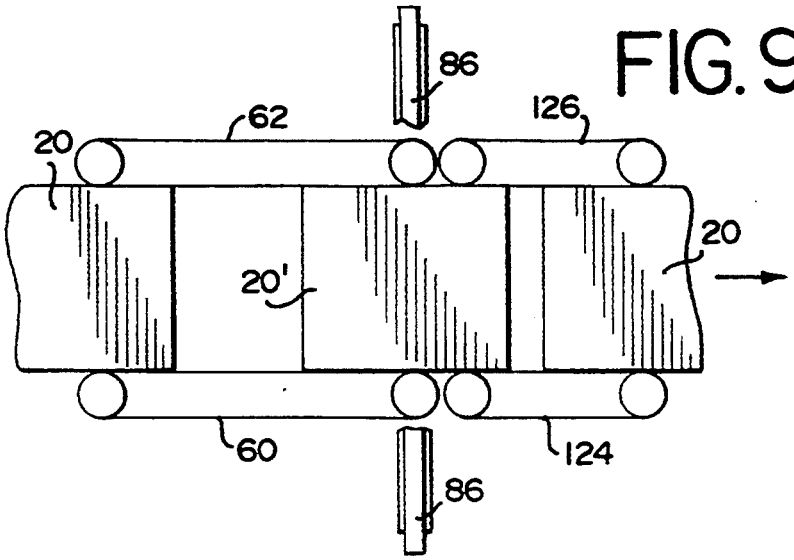
FIG. 9 is a view similar to FIG. 8, and showing how a package progresses from the upstream side pull belts to the downstream side pull belts while the upstream side pull belts are temporarily shifted, FIG. 10 illustrate one form of controller according to the invention.

FIGS. 7 through 9 illustrate schematically the transition from the pull belts 60 and 62 of the conveying and lap sealing section 14 through the sealing section 16 to the pull belt assemblies 124 and 126 of the outlet section 18o When the group 20 is compressed somewhat as described above, it is necessary to retain that compression until sealing has been fully completed. After the sealing dies 86 and 88 open and the pull belts of the conveying and lap sealing section 14 and outlet section 18 begin to advance their respective groups 20, the group 20 within the conveying and lap sealing section must pass through a gap in the sealing section 16 between the pull belts 60 and 62 of the conveying and lap sealing section 14 and the pull belt assemblies 124 and 126 of the outlet section 18, As the group 20, under compression, exits the pull belts 60 and 62, it naturally begins to expand when unrestrained in the gap of the end sealing section 16. That is shown in the group 20' in a somewhat exaggerated manner where the right-most end of the group 20' has expanded to a greater extent than the spacing between the pull belt assemblies 124 and 126. As the group 20' contacts the pull belt assemblies 124 and 126, while the group 20' may pass therebetween, the items and film thereabout are unevenly caught by the pull belts 124 and 126, and an unsightly package can result. To minimize or eliminate expansion and avoid damage to or marring of the group 20' it is preferred that the pull belts 60 and 62 are moved temporarily to close the gap normally occupied by the closing sealing dies 86 and 88. This permits a smooth transition, and once the group 20' has left the pull belts 60 and 62, the pull belts 60 and 62 are retracted to return the gap between the conveying end lap sealing section 14 and the outlet section 18 to permit the sealing dies of the sealing section 16 to be closed an the sealing to progress as described above.

Figure 10:
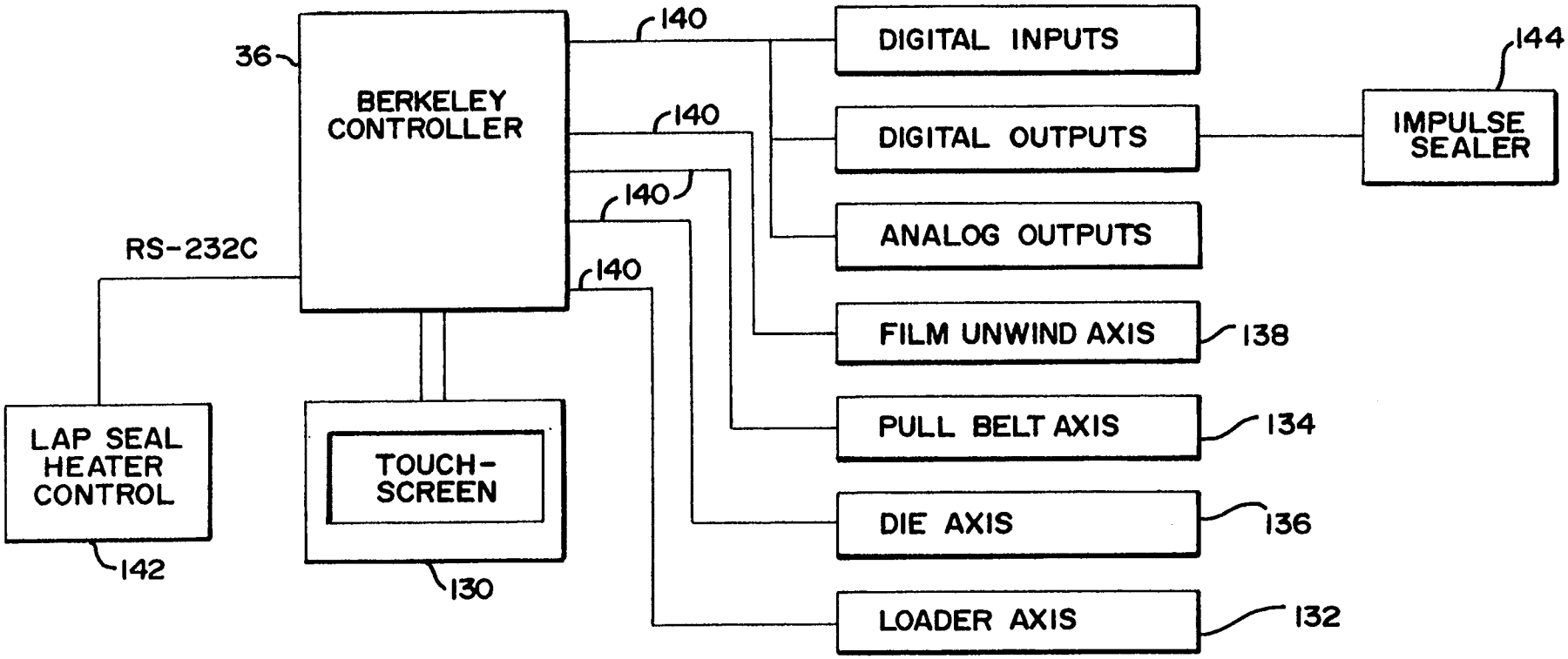

FIG. 10 illustrates very simply a control arrangement which can be used in connection with the apparatus just described above. In this form of the invention, the controller 36 is a Berkeley BAM-432 controller, although obviously other apparatus can be used, as well. The controller 36 is programmed and controlled through a touch screen 130. Four interrelated axes are connected to the controller 36, the loader axis 132 of the input section 12, the pull belt axis 134 of the conveying and lap sealing section 14 and the outlet section 18, the die axis 136 of the sealing section 16, and a film unwind axis 138 of the film 72 as it is unwound from the roll 68. All axes are appropriately connected by lines 140 to the controller 36. Other inputs and outputs can also be provided to the controller 36 to control the various functions of the apparatus 10.

The loader axis 132 is activated during the time that the pull belt axis 134 is in operation to advance and control the pusher plate 54 throughout its sequence of operation. The pull belt axis 134 operates the pull belts in the conveying and lap sealing section 14 to simultaneously advance the film and enveloped group 20 therewithin. The die axis 136 activates the sealing dies 86 and 88 of the sealing section 16, and the film unwind axis 138 controls unwinding of the film 72 from the roll 70. Tension of the film 72 is controlled in the film unwind axis 138. The heat of the lap seal of the lap sealer 76 is controlled by a lap seal heater control 142, while the seal energy of the sealing ribbons 106 and 108 is controlled by an impulse sealer 144.

It will be evident that other control apparatus can be employed to operate the apparatus 10 of the invention as described herein. The Berkley controller 36 has been employed by the applicant successfully, and a PLC/Berkley controller combination has been used, as well, but obviously other types of apparatus can be utilized so long as the sequence of operation is as described above.

FIGS. 11 through 14 illustrate the forming of gussets between two succeeding groups of items 20 when vacuum is solely used to form the gussets. The cross-sections illustrated are intended to be taken at the location of the sealing dies 86 and 88 as vacuum is applied.

Figure 11A:
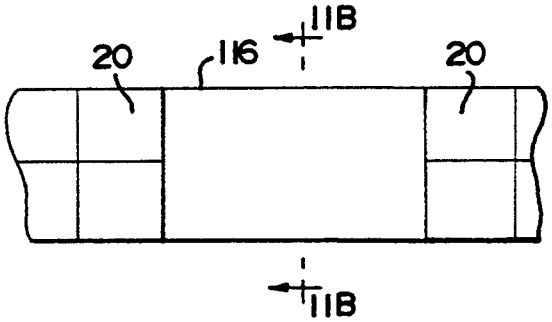
FIG. 11A is a schematic side elevational illustration of the packaging tube and items encapsulated therewithin at the located of the gusset forming and sealing.
Figure 11B:
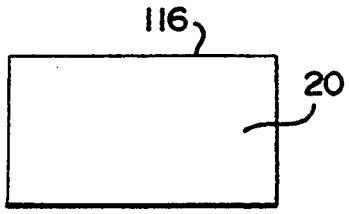
Fig. 11B is a cross-sectional view taken along lines 11B—11B of FIG. 11A.
Figure 12A:
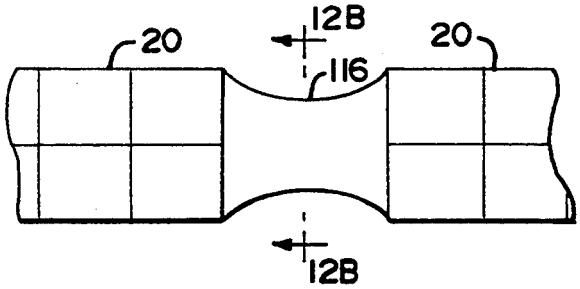
FIG. 12A is a view similar to FIG. 11B, but showing the upstream group of items advancing toward the downstream group of items while vacuum is applied to withdraw excess air entrapped between the successive groups of items.
Figure 12B:
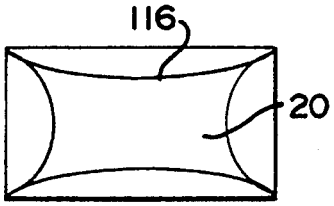
FIG. 12B is a cross-sectional illustration taken along lines 12B—12B of FIG. 12A.

In FIGS. 11A and 11B, the right-most group 20 has been halted in forward motion, and vacuum has just begun to be applied. At this instance, there is no deflection of the tube 116 extending between the two groups 20. In FIGS. 12A and 12B, however, vacuum continues to be applied and the left-most group 20 continues to be advanced toward the right-most group. The tube 116 begins to uniformly "deflate" with application of the vacuum, as shown in the cross-section of FIG. 12B.

Figure 13A:
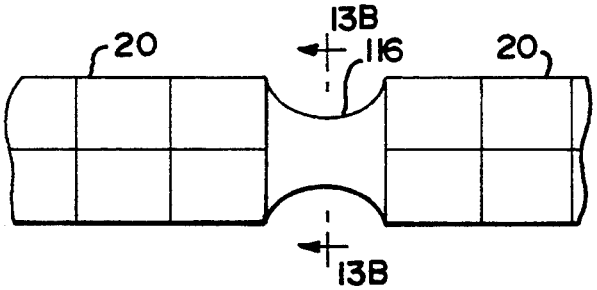
FIG. 13A is a view similar to FIG. 12A, but showing the gap between the successive groups of items further shortened and additional air having been withdrawn from the gap therebetween.
Figure 13B:
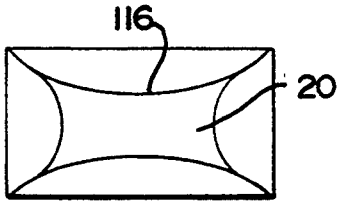
FIG. 13B is a cross-sectional illustration taken along lines 13B—13B of FIG. 13A.
Figure 14A:
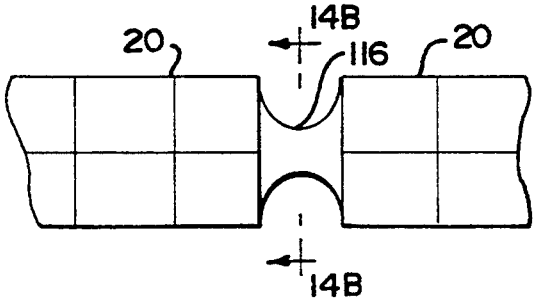
FIG. 14A is a further side elevational illustration similar to that of FIG. 12A, and showing the gap between the two successive groups of items substantially lessened just prior to closing of the sealing dies.
Figure 14B:
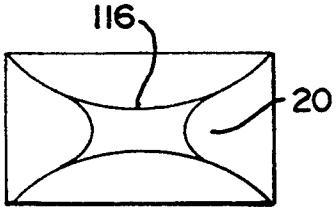
FIG. 14B is a cross-sectional illustration taken along lines 14B—14B of FIG. 14A.

FIGS. 13A and 13B further illustrate the gusset forming, as the left-most group 20 advances toward the right-most group 20, and vacuum continues to be applied. As shown in the cross section of FIG. 13B, uniform collapsing of the tube 116 continues. Finally, as shown in FIGS. 14A and 14B, an essentially full collapse of the tube 116 has occurred, and at this point the dies 86 and 88 (not illustrated in these figures) are closed, clamping the now-collapsed tube 116 therebetween for the severing and sealing operations.

Various changes can be made to the invention without departing from the spirit thereof or scope of the following claims.

What is claimed is:

1. An apparatus operated intermittently for enveloping successive groups of items in a film as the items are transferred from an upstream location to a downstream location, comprising a. means for collating and accumulating a selected quantity of items in a group, b. a source of packaging film, c. means for forming the packaging film into a film tube during a packaging cycle, d. means for placing an upstream group of items in an equally spaced apart relationship with a downstream group of items located in the film tube with the packaging film being stationary, e. means for the placing means, upstream group, downstream group and the film in unison, without the placing means entering the film tube, and f. means for clamping, severing and sealing the tube adjacent to an inserted group of items.

2. An apparatus according to claim 1 in which said means for collating and accumulating comprises a stationary collating surface, and including means for laterally compressing a group of items.

3. An apparatus according to claim 2 in which said means for laterally compressing comprises opposite side plates located on opposite sides of an accumulated group of items and means for shifting said side plates toward one another to compress a group of items therebetween.

4. An apparatus according to claim 3 including two pairs of said side plates located in series.

5. An apparatus according to claim 1 in which said means for collating and accumulating comprises a stationary collator, and said inserting means comprises a pusher plate engagable with an upstream end of said group of items.

6. An apparatus according to claim 5 including means for reciprocating said pusher plate to push said group of items into the tube and return said pusher plate to an initial position.

7. An apparatus according to claim 6 including means for raising said pusher plate to avoid interference with a succeeding group of items.

8. An apparatus according to claim 1 in which said advancing means comprises at least one fixed side pull belt positioned on each side of a group of items, and a motor for synchronously propelling said pull belts.

9. An apparatus according to claim 8 in which said inserting means includes a drive motor and in which the drive motor of the inserting means and the drive motor of said side pull belts are connected to a controller such that the said inserting means and said pull belts advance the tube and group of items at a same linear velocity.

10. An apparatus according to claim 8 in which said advancing means further comprises top and bottom pull belts, and including means for driving said top and bottom pull belts in synchronism with said side pull belts.

11. An apparatus according to claim 8 including a second pair of pull belts spaced from and located downstream from said fixed pull belts.

12. An apparatus according to claim 11 including means for temporarily moving said fixed pull belts to decrease spacing between said fixed pull belts and said second pair of pull belts.

13. An apparatus according to claim 1 including a pair of pull belts spaced from and located downstream from said clamping, severing and sealing means, each belt engaging an opposite side of a group of items.

14. An apparatus according to claim 13 including means for separating said pull belts to temporarily release a group of items.

15. An apparatus according to claim 1 including means for lap sealing the tube.

16. An apparatus according to claim 1 in which said clamping, severing and sealing means comprises a pair of vertically moveable dies located immediately downstream of said advancing means.

17. An apparatus according to claim 1 including vacuum means for withdrawing excess air from the tube.

18. An apparatus according to claim 17 in which said vacuum means comprises an elongated lance having an air inlet proximate said clamping, severing and sealing means.

19. An apparatus according to claim 18 in which said lance extends form a position upstream of said forming means, through the formed tube, to said clamping, severing and sealing means.

20. An apparatus according to claim 1 including means for shaping gussets in the tube at said clamping, severing and sealing means.

21. An apparatus according to claim 20 in which said shaping means comprises opposite gusset plates, and including means for reciprocating said gusset plates to tuck opposite sides of the tube.

22. An apparatus according to claim 21 including vacuum means for withdrawing excess air from the tube.

23. An apparatus according to claim 20 in which said shaping means comprises means to shorten a gap between two succeeding groups of items in the tube and vacuum means to withdraw excess air between said two succeeding groups as said gap is shortened.

24. An apparatus according to claim 23 in which said means to shorten comprises means to halt a downstream group of items and the tube thereabout while an upstream group of items and the tube thereabout is conveyed toward the downstream group.

25. A method for intermittently enveloping successive groups of items in a packaging film as the items progress from an upstream location to a downstream location, the method comprising the steps of a. collating and accumulating a selected quantity of items in a group, b. forming the packaging film into a film tube during a packaging cycle, c. placing an upstream group of items into the tube during a packaging cycle in an equally spaced apart relationship with a downstream group of items located in the film tube with the packaging film being stationary, d. advancing the pushing device, upstream group, downstream group and the film in unison, without the pushing device entering the film tube, and e. severing and sealing the tube at a location between successive groups of items.

26. The method according to claim 25 in which method step "a" includes the step of laterally compressing each group of items before method step "c".

27. The method according to claim 25 in which method step "c" includes pushing a group of items at a generally constant velocity at an upstream end while method step "d" includes simultaneously engaging the tube on opposite sides with side pull belts, and advancing the tube and group of items at the same velocity.

28. The method according to claim 27 in which method step "d" further includes engaging the tube with top and bottom pull belts and driving the top and bottom pull belts in synchronism with the side pull belts.

29. The method according to claim 28 including compressing the group of items vertically between the top and bottom pull belts.

30. The method according to claim 25 including conveying of the group of items by conveying means downstream of the location of severing and sealing of the tube.

31. The method according to claim 30 in which advancing of the tube and groups of items is with opposite side pull belts normally fixed in place and spaced from the downstream conveying means, and including the step of temporarily moving the side pull belts toward the downstream conveying means to reduce the spacing between the side pull belts and the downstream conveying means as a group of items passes from the side pull belts to the downstream conveying means.

32. The method according to claim 30 in which the downstream conveying means comprises a pair of spaced apart pull belts engaging opposite sides of the group of items, and including the step of separating the pull belts when a group of items is past said location to permit the group of items to retreat toward said location prior to step "e".

33. The method according to claim 25 including the step of withdrawing excess air from the tube prior to step "e".

34. The method according to claim 25 including the step of shaping gussets in the tube prior to step "e".

35. The method according to claim 34 in which the step of shaping includes shortening separation between two succeeding groups of items.

36. The method according to claim 35 including simultaneously applying a vacuum to withdraw excess air between the two groups as the separation is shortened.

* * * * *